US007308871B2

(12) United States Patent
Machida

(10) Patent No.: US 7,308,871 B2
(45) Date of Patent: Dec. 18, 2007

(54) CONTROL APPARATUS FOR VARIABLE VALVE APPARATUS AND METHOD THEREOF

(75) Inventor: Kenichi Machida, Isesaki (JP)
(73) Assignee: Hitachi, Ltd., Tokyo (JP)

( * ) Notice: Subject to any disclaimer, the term of this patent is extended or adjusted under 35 U.S.C. 154(b) by 213 days.
(21) Appl. No.: 11/049,868
(22) Filed: Feb. 4, 2005
(65) Prior Publication Data
US 2005/0172920 A1 Aug. 11, 2005
(30) Foreign Application Priority Data
Feb. 6, 2004 (JP) ..... 2004-031032
(51) Int. Cl.
*F01L 1/34* (2006.01)
(52) U.S. Cl. ..... 123/90.15; 123/90.17; 123/90.11
(58) Field of Classification Search ..... 123/90.15, 123/90.16, 90.17, 90.18, 90.11, 90.27, 90.31; 464/1, 2, 160
See application file for complete search history.

(56) References Cited

U.S. PATENT DOCUMENTS 5,024,191 A * 6/1991 Nagahiro et al. ..... 123/198 D
6,073,610 A * 6/2000 Matsumoto et al. ..... 123/396
6,135,085 A * 10/2000 Toyohara et al. ..... 123/306
6,595,172 B2 * 7/2003 Kabasin et al. ..... 123/90.16

FOREIGN PATENT DOCUMENTS

JP 2001-254637 A 9/2001

* cited by examiner

*Primary Examiner*—Ching Chang
(74) *Attorney, Agent, or Firm*—Foley & Lardner LLP

(57) ABSTRACT

An engine control unit diagnoses whether or not a unit that controls a variable valve apparatus is failed, and when it is diagnosed that the unit is failed, the engine control unit shuts off the power supply to a drive circuit for an actuator of the variable valve apparatus.

9 Claims, 14 Drawing Sheets

CONTROL APPARATUS FOR VARIABLE VALVE APPARATUS AND METHOD THEREOF

BACKGROUND OF THE INVENTION

1. Field of the Invention

The present invention relates to a control apparatus for a variable valve apparatus which varies an operating characteristic of an engine valve in an internal combustion engine, and a method thereof.

2. Description of the Related Art

Japanese Unexamined Patent Publication No. 2001-254637 discloses an apparatus for diagnosing the malfunction of a variable valve lift apparatus which varies a lift amount of an engine valve.

In the above diagnosis apparatus, it is judged that the variable valve lift apparatus is malfunctioned, when a change in lift amount of the engine valve is equal to or smaller than a predetermined value and also when an absolute value of the deviation between the lift amount of the engine valve and a target value thereof exceeds a predetermined value.

If a control unit that controls the variable valve lift apparatus is operated normally, it is possible to execute the fail-safe processing when the variable valve lift apparatus is malfunctioned.

However, in the above diagnosis apparatus, there has been a problem in that the fail-safe processing cannot be executed if the control unit is failed.

SUMMARY OF THE INVENTION

It is therefore an object of the present invention to provide a control apparatus capable of executing the fail-safe processing, even if a control unit that controls a variable valve mechanism is failed.

In order to achieve the above object, according to the present invention, there is provided a second control unit that monitors an operating condition of a first control unit that controls a variable valve apparatus, to diagnose whether or not the first control unit is failed.

The other objects and features of the invention will become understood from the following description with reference to the accompanying drawings.

PREFERRED EMBODIMENTS

Figure 1:
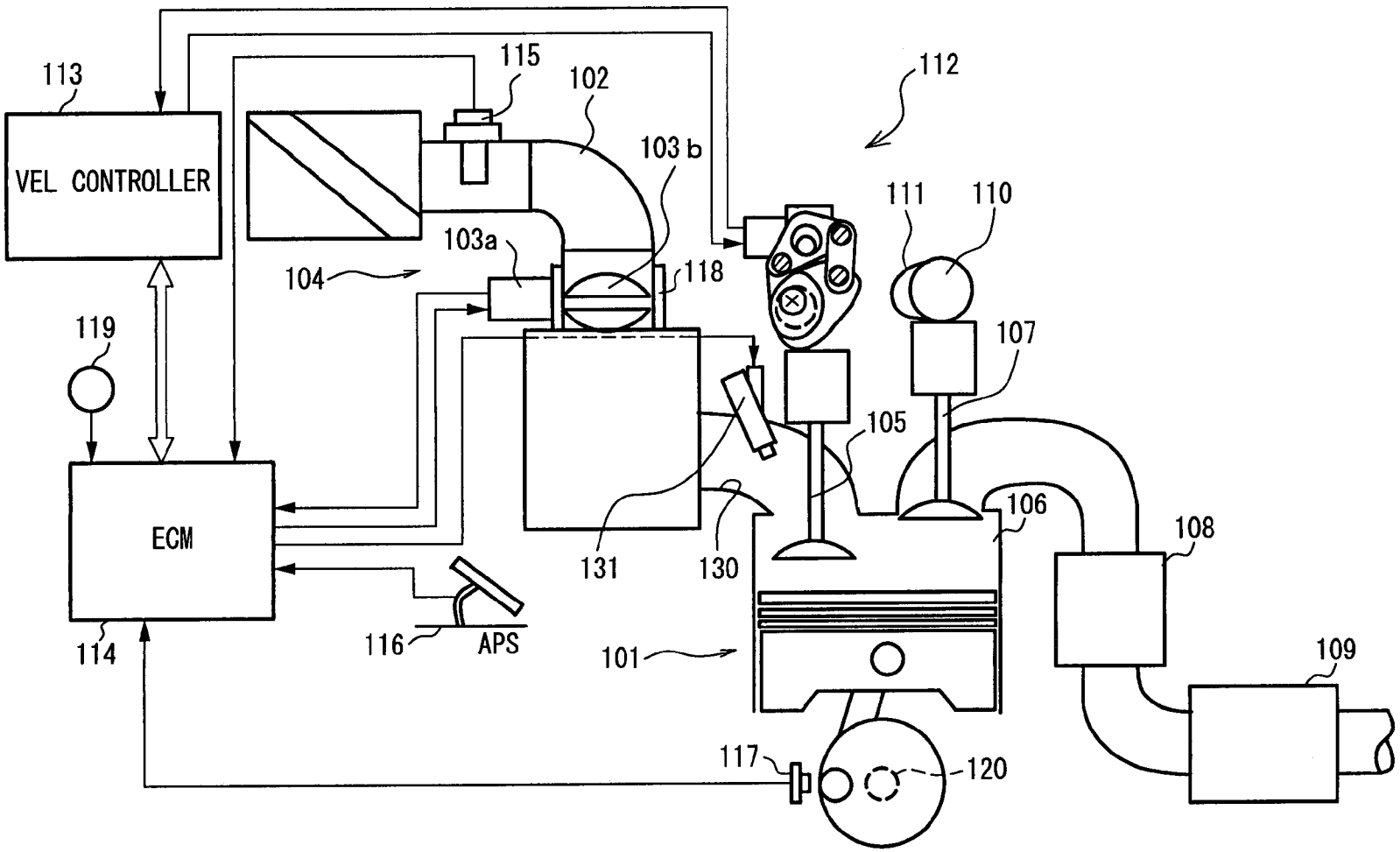
FIG. 1 is a systematic diagram of an engine in an embodiment of a present invention.

FIG. 1 is a systematic diagram of a vehicle engine in an embodiment.

In FIG. 1, in an intake pipe 102 of an internal combustion engine 101, an electronically controlled throttle 104 is disposed.

Electronically controlled throttle 104 is a device for driving a throttle valve 103*b* to open and close by a throttle motor 103*a*.

Then, air is sucked into a combustion chamber 106 of engine 101 via electronically controlled throttle 104 and an intake valve 105.

A combusted exhaust gas is discharged from combustion chamber 106 via an exhaust valve 107, and thereafter, is purified by a front catalyst 108 and a rear catalyst 109, to be emitted into the atmosphere.

Exhaust valve 107 is driven by a cam 111 axially supported by an exhaust side camshaft 110, to open and close, while maintaining a fixed lift amount, a fixed valve operating angle and fixed valve timing.

On the other hand, there is disposed a variable valve event and lift (VEL) mechanism 112 which continuously varies a lift amount of intake valve 105 as well as an operating angle thereof.

Here, an engine control module (ECM) 114 and a VEL controller 113 are disposed.

ECM 114 (a second control unit) computes a target lift amount, and VEL controller 113 (a first control unit) controls VEL mechanism 112 so as to obtain the target lift amount.

ECM 114 receives detection signals from various sensors.

As the various sensors, there are disposed an air flow meter 115 detecting an intake air flow amount of engine 101, an accelerator opening sensor 116 detecting an accelerator opening degree, a crank angle sensor 117 taking a crank rotation signal out of crankshaft 120, a throttle sensor 118 detecting an opening degree TVO of throttle valve 103*b* and a water temperature sensor 119 detecting a cooling water temperature of engine 101.

Further, a fuel injection valve 131 is disposed on an intake port 130 at the upstream side of intake valve 105.

Fuel injection valve 131 is driven to open based on an injection pulse signal from ECM 114 to inject fuel of an amount proportional to the injection pulse width of the injection pulse signal.

Further, ECM 114 computes ignition timing (ignition advance value) based on the fuel injection pulse width and an engine rotation speed, to control the ignition timing by an ignition plug (not shown in the figure).

Figure 2:
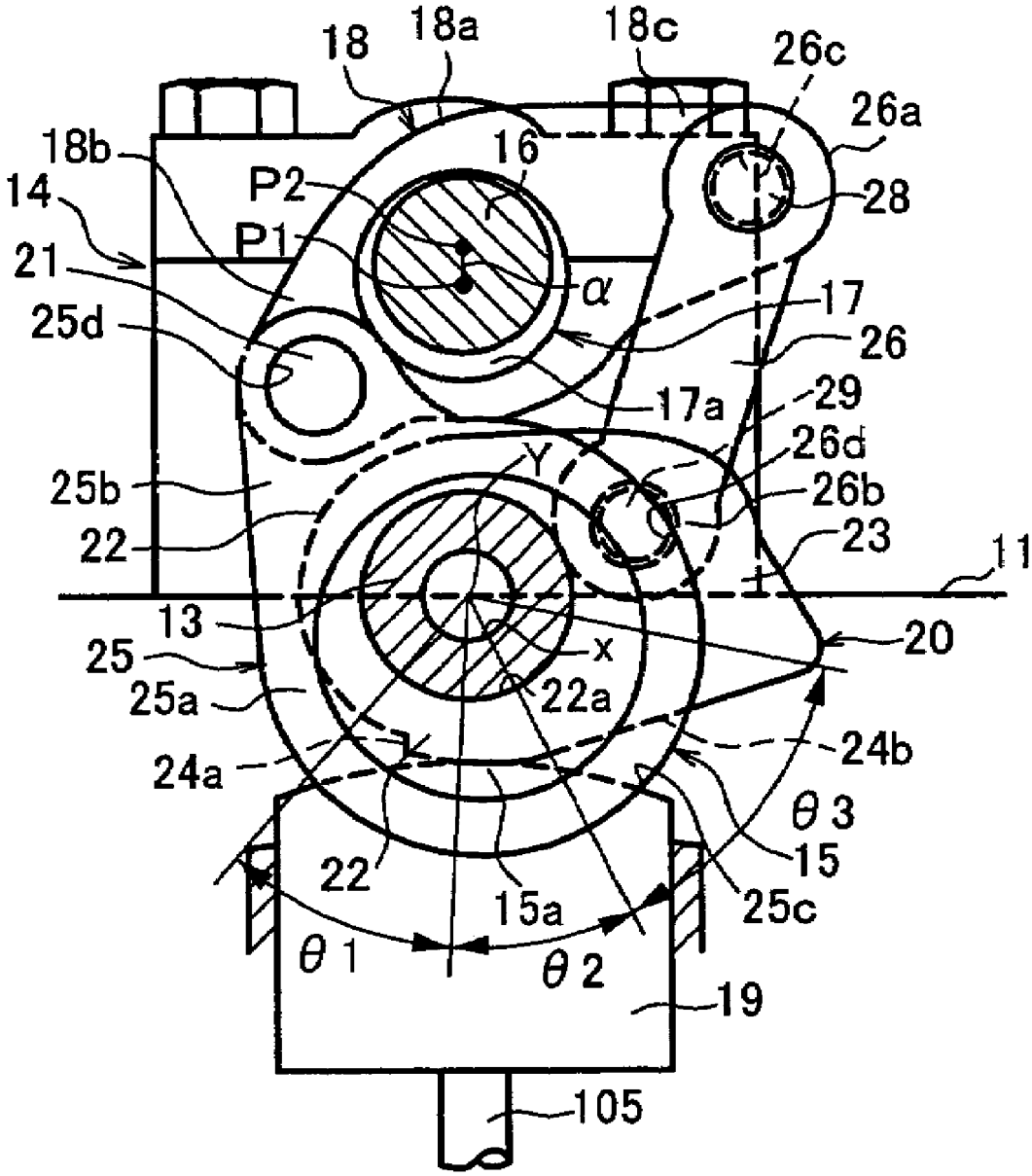
FIG. 2 is a cross section view showing a variable valve event and lift mechanism in the embodiment (A-A cross section view in FIG. 3).
Figure 3:
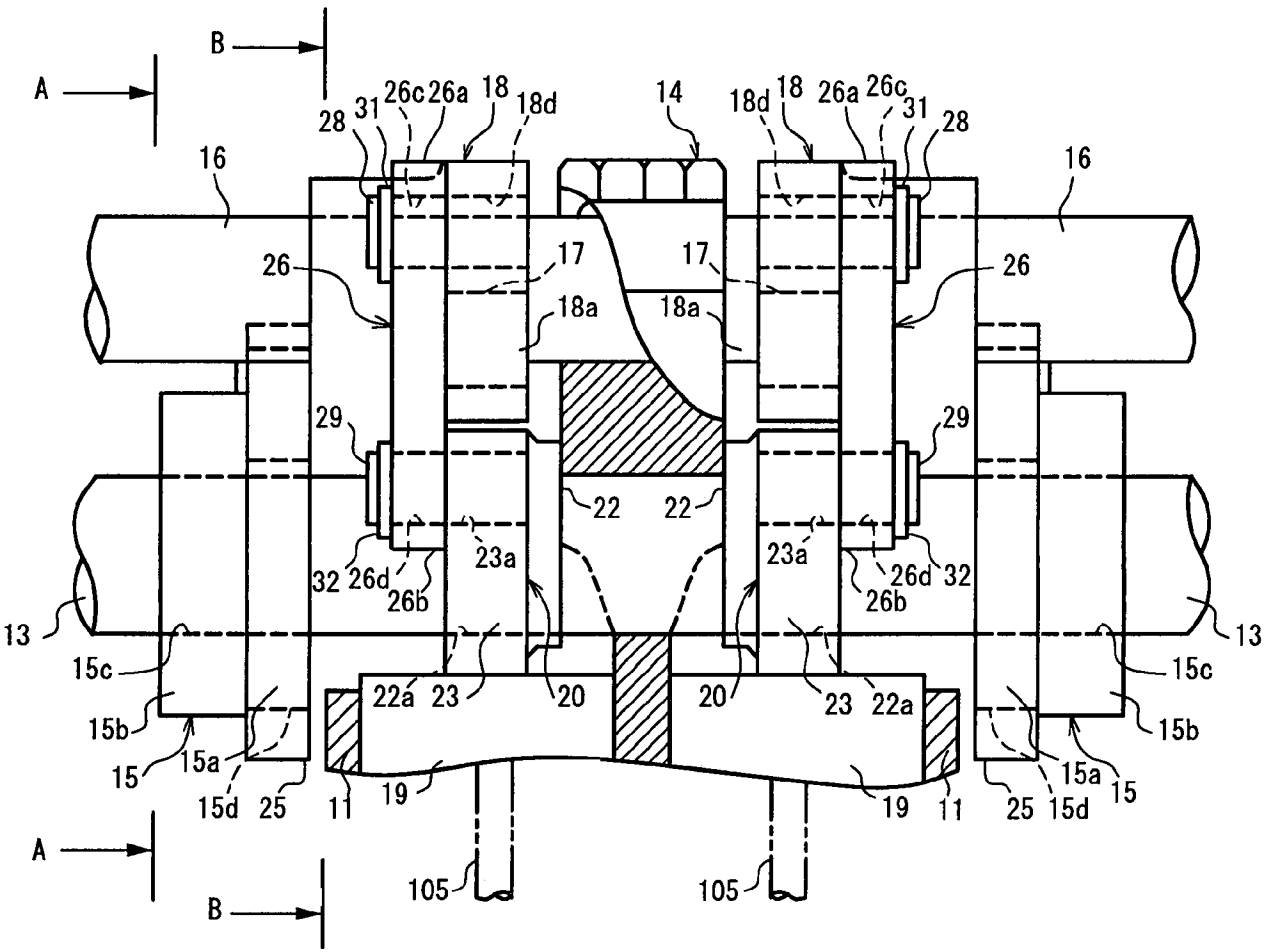
FIG. 3 is a side elevation view of the variable valve event and lift mechanism.
Figure 4:
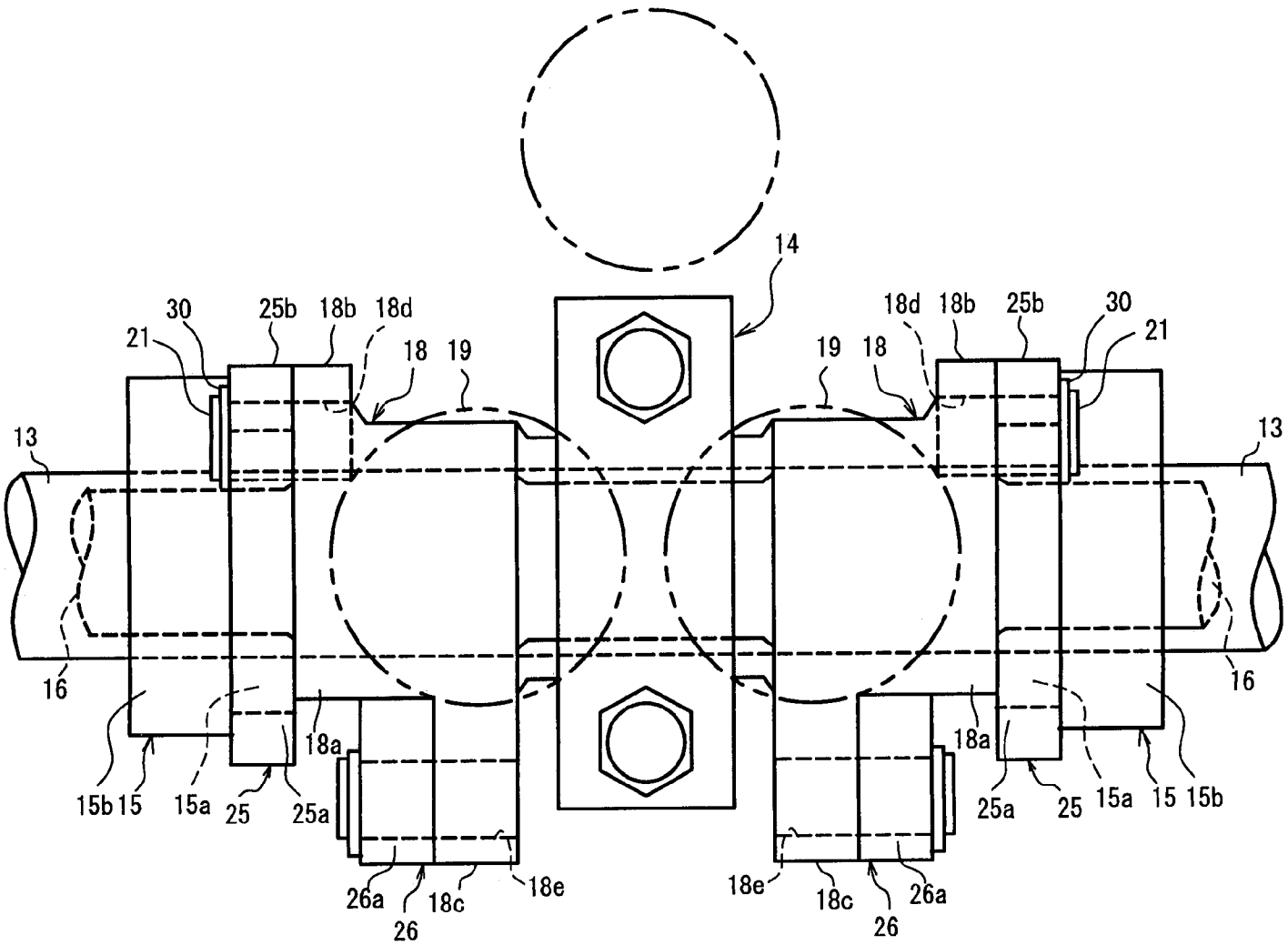
FIG. 4 is a top plan view of the variable valve event and lift mechanism.

FIG. 2 to FIG. 4 show in detail the structure of VEL mechanism 112.

VEL mechanism 112 shown in FIG. 2 to FIG. 4 includes a pair of intake valves 105, 105, a hollow camshaft 13 rotatably supported by a cam bearing 14 of a cylinder head 11, two eccentric cams 15, 15 (drive cams) being rotation cams which are axially supported by camshaft 13, a control shaft 16 rotatably supported by cam bearing 14 and arranged in parallel at an upper position of camshaft 13, a pair of rocker arms 18, 18 swingingly supported by control shaft 16 through a control cam 17, and a pair of independent swing cams 20, 20 disposed to upper end portions of intake valves 105, 105 through valve lifters 19, 19, respectively.

Eccentric cams 15, 15 are connected with rocker arms 18, 18 by link arms 25, 25, respectively. Rocker arms 18, 18 are connected with swing cams 20, 20 by link members 26, 26.

Rocker arms 18, 18, link arms 25, 25, and link members 26, 26 constitute a transmission mechanism.

Figure 5:
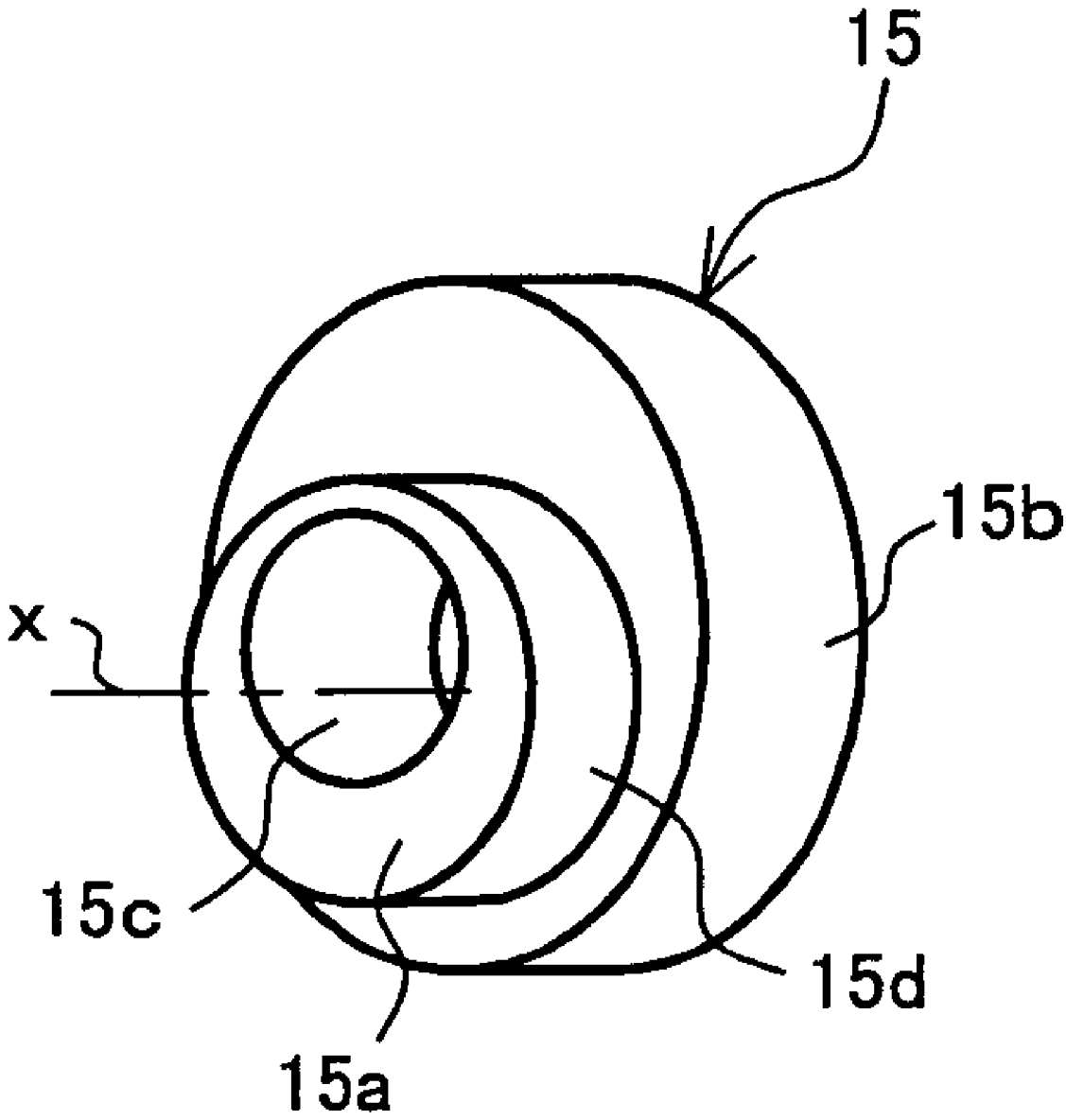
FIG. 5 is a perspective view showing an eccentric cam for use in the variable valve event and lift mechanism.

Each eccentric cam 15, as shown in FIG. 5, is formed in a substantially ring shape and includes a cam body 15*a* of small diameter, a flange portion 15*b* integrally formed on an outer surface of cam body 15*a*. A camshaft insertion hole 15*c* is formed through the interior of eccentric cam 15 in an axial direction, and also a center axis X of cam body 15*a* is biased from a center axis Y of camshaft 13 by a predetermined amount.

Eccentric cams 15, 15 are pressed and fixed to camshaft 13 via camshaft insertion holes 15*c* at outsides of valve lifters 19, 19, respectively, so as not to interfere with valve lifters 19, 19.

Each rocker arm 18, as shown in FIG. 4, is bent and formed in a substantially crank shape, and a central base portion 18*a* thereof is rotatably supported by control cam 17.

A pin hole 18*d* is formed through one end portion 18*b* which is formed to protrude from an outer end portion of base portion 18*a*. A pin 21 to be connected with a tip portion of link arm 25 is pressed into pin hole 18*d*. A pin hole 18*e*. Is formed through the other end portion 18*c* which is formed to protrude from an inner end portion of base portion 18*a*. A pin 28 to be connected with one end portion 26*a* (to be described later) of each link member 26 is pressed into pin hole 18*e*.

Control cam 17 is formed in a cylindrical shape and fixed to an outer periphery of control shaft 16. As shown in FIG. 2, a center axis P1 position of control cam 17 is biased from a center axis P2 position of control shaft 16 by $\alpha$.

Figure 6:
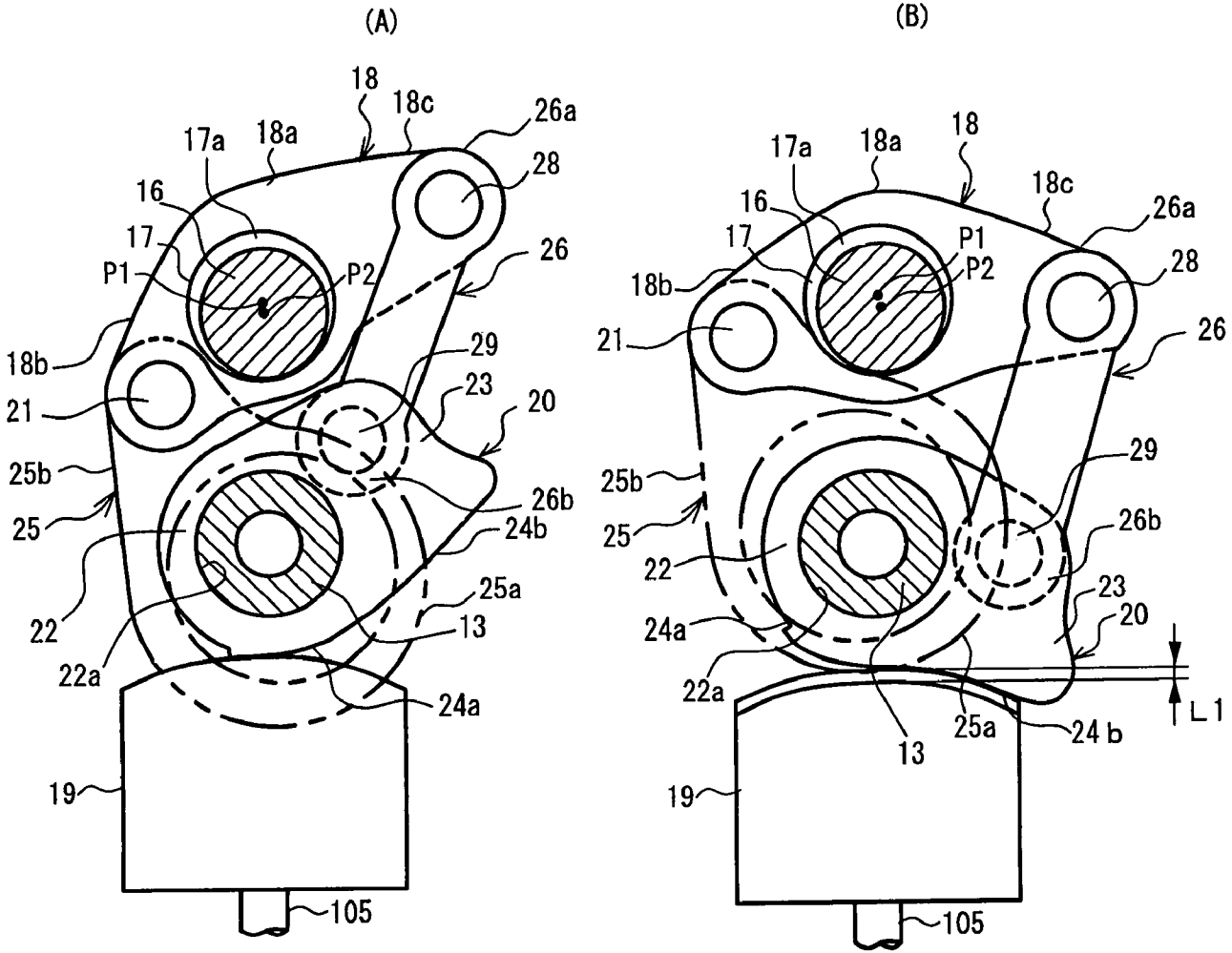
FIG. 6 is a cross section view showing a low lift control condition of the variable valve event and lift mechanism (B-B cross section view of FIG. 3).
Figure 7:
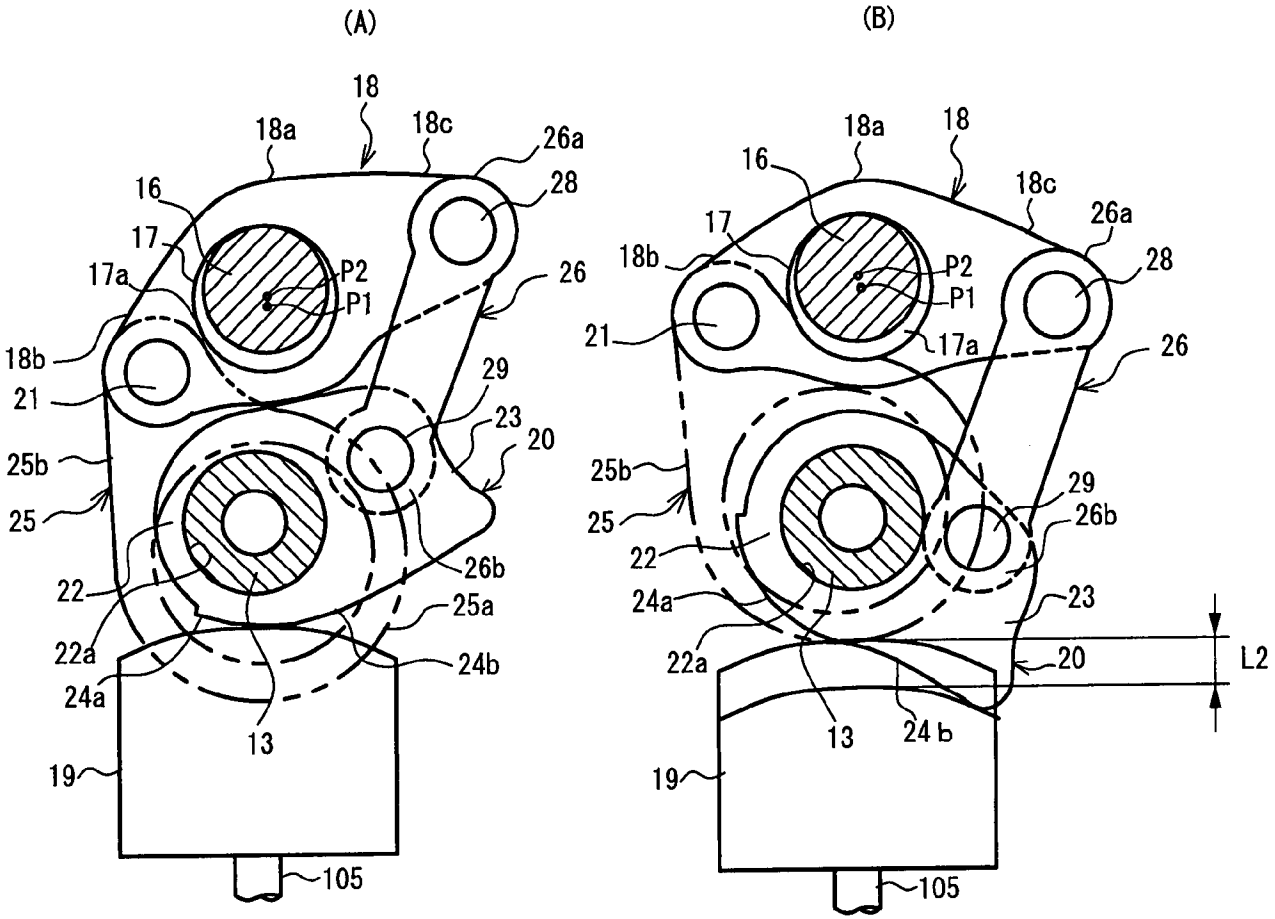
FIG. 7 is a cross section view showing a high lift control condition of the variable valve event and lift mechanism (B-B cross section view of FIG. 3).

Swing cam 20 is formed in a substantially lateral U-shape as shown in FIG. 2, FIG. 6 and FIG. 7, and a supporting hole 22*a* is formed through a substantially ring-shaped base end portion 22. Camshaft 13 is inserted into supporting hole 22*a* to be rotatably supported. Also, a pin hole 23*a* is formed through an end portion 23 positioned at the other end portion 18*c* of rocker arm 18.

A base circular surface 24*a* of base end portion 22 side and a cam surface 24*b* extending in an arc shape from base circular surface 24*a* to an edge of end portion 23, are formed on a bottom surface of swing cam 20. Base circular surface 24*a* and cam surface 24*b* are in contact with a predetermined position of an upper surface of each valve lifter 19 corresponding to a swing position of swing cam 20.

Figure 8:
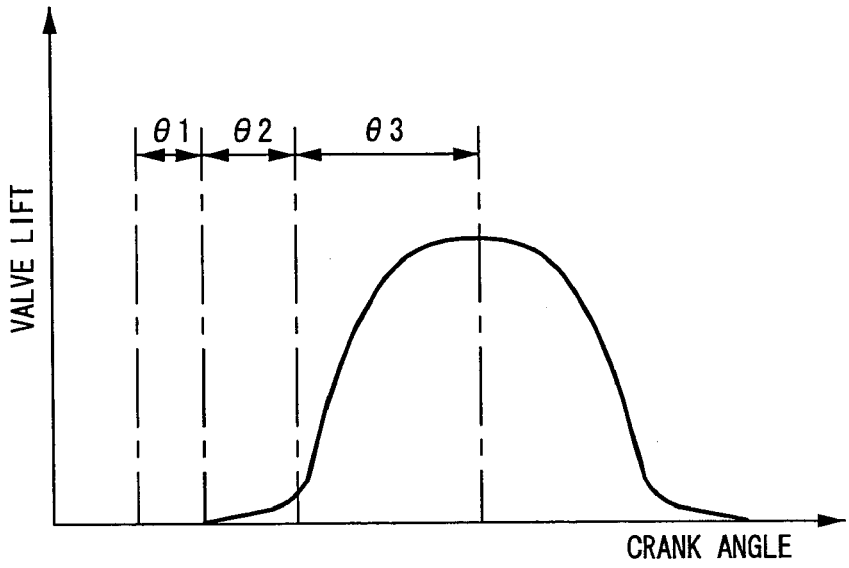
FIG. 8 is a graph showing a lift characteristic of an intake valve in the variable valve characteristic mechanism.

Namely, according to a valve lift characteristic shown in FIG. 8, as shown in FIG. 2, a predetermined angle range $\theta 1$ of base circular surface 24*a* is a base circle interval and a range of from base circle interval $\theta 1$ of cam surface 24*b* to a predetermined angle range $\theta 2$ is a so-called ramp interval, and a range of from ramp interval $\theta 2$ of cam surface 24*b* to a predetermined angle range $\theta 3$ is a lift interval.

Link arm 25 includes a ring-shaped base portion 25*a* and a protrusion end 25*b* protrudingly formed on a predetermined position of an outer surface of base portion 25*a*. A fitting hole 25*c* to be rotatably fitted with the outer surface of cam body 15*a* of eccentric cam 15 is formed on a central position of base portion 25*a*. Also, a pin hole 25*d* into which pin 21 is rotatably inserted is formed through protrusion end 25*b*.

Link member 26 is formed in a linear shape of predetermined length and pin insertion holes 26*c*, 26*d* are formed through both circular end portions 26*a*, 26*b*. End portions of pins 28, 29 pressed into pin hole 18*d* of the other end portion 18*c* of rocker arm 18 and pin hole 23*a* of end portion 23 of swing cam 20, respectively, are rotatably inserted into pin insertion holes 26*c*, 26*d*.

Snap rings 30, 31, 32 restricting axial transfer of link arm 25 and link member 26 are disposed on respective end portions of pins 21, 28, 29.

In such a constitution, depending on a positional relation between the center axis P2 of control shaft 16 and the center axis P1 of control cam 17, as shown in FIG. 6 and FIG. 7, the valve lift amount is varied, and by driving control shaft 16 to rotate, the position of the center axis P2 of control shaft 16 relative to the center axis P1 of control cam 17 is changed.

Figure 9:
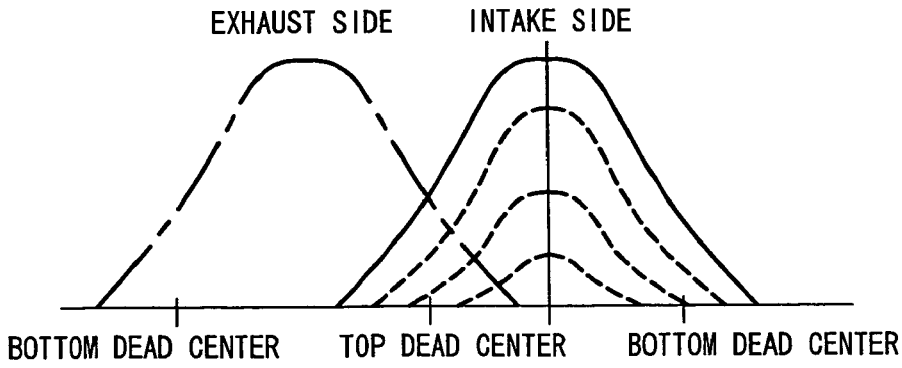
FIG. 9 is a graph showing a correlation between valve timing and a lift amount in the variable valve event and lift mechanism.
Figure 10:
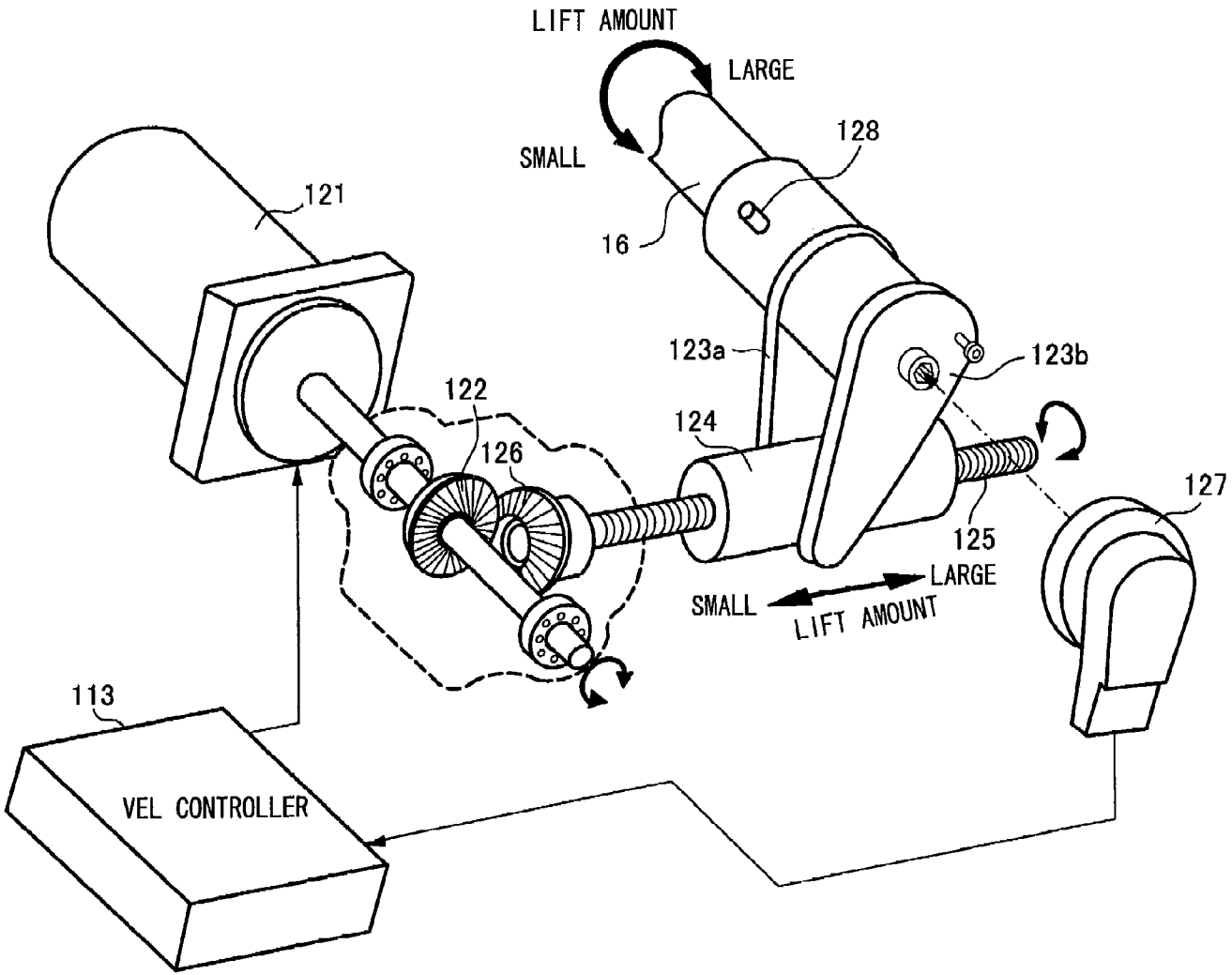
FIG. 10 is a perspective view showing a driving mechanism of a control shaft in the variable valve event and lift mechanism.

Control shaft 16 is driven to rotate within a predetermined rotation angle range, which is restricted by a stopper, by a DC servo motor (actuator) 121 as shown in FIG. 10. By varying a rotation angle of control shaft 16 by actuator 121, the lift amount and operating angle of each of intake valves 105, 105 are continuously varied within a variable range between a maximum valve lift amount and a minimum valve lift amount, which is restricted by the stopper (refer to FIG. 9).

In FIG. 10, DC servo motor 121 is arranged so that a rotation shaft thereof is parallel to control shaft 16, and a bevel gear 122 is axially supported by a tip portion of the rotation shaft.

On the other hand, a pair of stays 123*a*, 123*b* is fixed to the tip end of control shaft 16. A nut 124 is swingingly supported around an axis parallel to control shaft 16 connecting tip portions of the pair of stays 123*a*, 123*b*.

A bevel gear 126 meshed with bevel gear 122 is axially supported at a tip end of a threaded rod 125 engaged with nut 124. Threaded rod 125 is rotated by the rotation of DC servo motor 121, and the position of nut 124 engaged with threaded rod 125 is displaced in an axial direction of threaded rod 125, so that control shaft 16 is rotated.

Here, the valve lift amount is decreased as the position of nut 124 approaches bevel gear 126, while the valve lift amount is increased as the position of nut 124 gets away from bevel gear 126.

Further, a potentiometer type angle sensor 127 detecting the angle of control shaft 16 is disposed on the tip end of control shaft 16, as shown in FIG. 10. VEL controller 113 feedback controls DC servo motor 121 so that an angle detected by angle sensor 127 coincides with a target angle (a value equivalent to the target lift amount).

A stopper member 128 is formed to protrude from the outer periphery of control shaft 16.

When stopper member 128 is in contact with a receiving member on the fixing side (not shown in the figure) in both of a valve lift amount increasing direction and a valve lift amount decreasing direction, the rotation range (variable range of the valve lift amount) of control shaft 16 is restricted.

Figure 11:
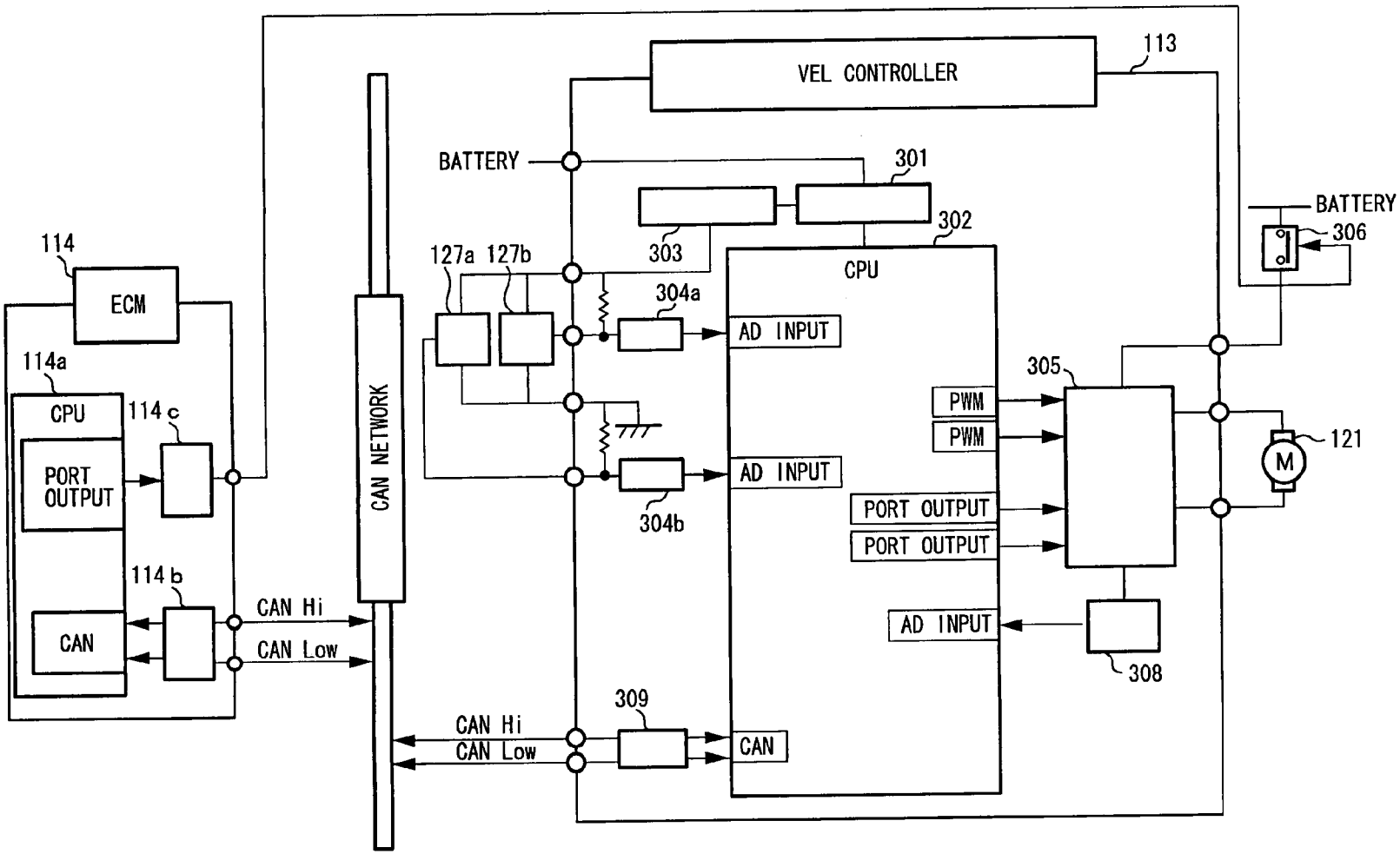
FIG. 11 is a circuit block diagram of a VEL controller.

FIG. 11 shows a configuration of VEL controller 113.

A battery voltage is supplied to VEL controller 113, and the power is supplied to a CPU 302 via a power supply circuit 301.

Further, a power supply voltage from power supply circuit 301 is supplied to angle sensors 127*a*, 127*b* via a power supply buffer circuit 303.

Output signals from angle sensors 127*a*, 127*b* are read in CPU 302 via input circuits 304*a*, 304*b*.

Further, there is disposed a motor drive circuit 305 for driving DC servo motor 121.

Motor drive circuit 305 is a PWM system drive circuit which varies the pulse width of a pulse signal for turning ON/OFF a driving power source for DC servo motor 121 based on a direct current level of a control signal (pulse width modulated signal PWM) output from CPU 302, which varies the ON duty of the pulse signal to control an average voltage of DC servo motor 121.

In order to drive DC servo motor 121 in a normal rotation direction and in a reverse rotation direction, control signals for normal and reverse rotations are input to motor drive circuit 305 from CPU 302, other than the pulse width modulated signal PWM.

A battery voltage is supplied to motor drive circuit 305 via a relay circuit 306.

Relay circuit 306 is driven to turn ON/OFF by a relay drive circuit 114*c*.

Relay drive circuit 114*c* is controlled based on a port output from a CPU 114*a*.

Further, there is disposed a current detection circuit 308 which detects a current of DC servo motor 121.

Moreover, VEL controller 113 is provided with a communication circuit 309 for communicating between VEL controller 113 and ECM 114. ECM 114 is provided with a communication circuit 114*b* for communicating with VEL controller. Thus, the intercommunication can be performed between VEL controller 113 and ECM 114.

Then, the target angle of control shaft 16 computed in ECM 114 is transmitted to VEL controller 113, while an angle REVEL of control shaft 16 detected by angle sensor 127 is transmitted to ECM 114 from VEL controller 113.

Figure 12:
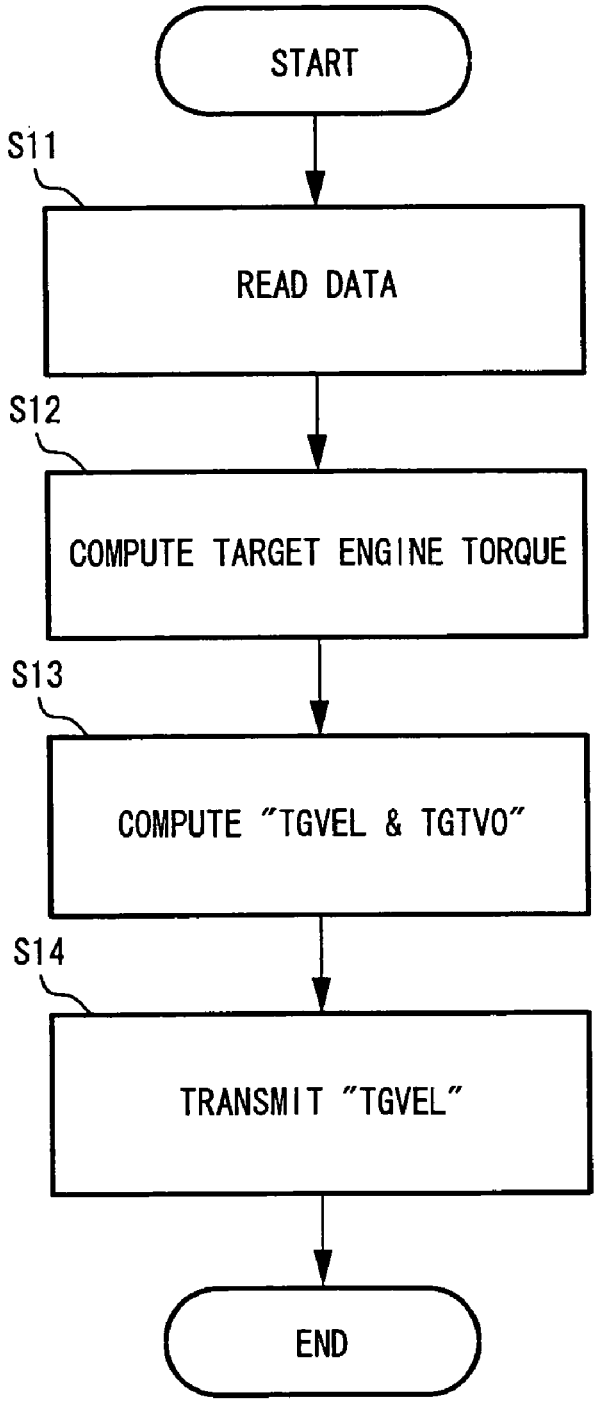
FIG. 12 is a flowchart showing the computation processing of a target value by an engine control module (ECM)

A flowchart in FIG. 12 shows the computation processing of the target value by ECM 114.

In step S11, data indicating engine operating conditions, such as, the accelerator opening, the engine rotation speed and the like, is read.

In step S12, a target engine torque is computed based on the data read in step S11.

In step S13, a target angle TGVEL of control shaft 16 and a target throttle opening TGTVO are computed based on the target engine torque.

In step S14, data of the target angle TGVEL is transmitted to VEL controller 113.

Figure 13:
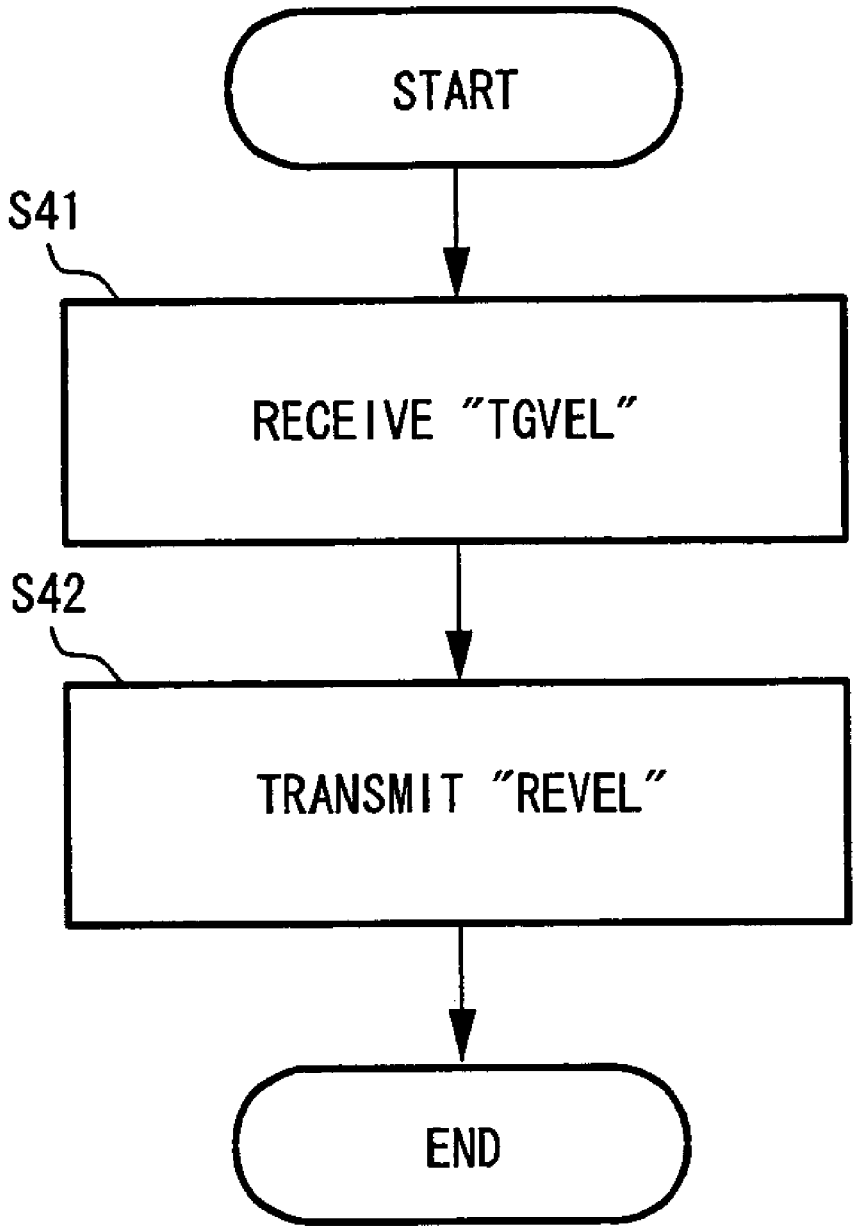
FIG. 13 is a flowchart showing the transmission and reception processing of data by the VEL controller.

A flowchart in FIG. 13 shows the transmission and reception processing of data by VEL controller 113.

In step S41, the transmission data including the target angle TGVEL from ECM 114 is received.

In step S42, data of the angle REVEL of control shaft 16 detected by angle sensor 127 is transmitted to ECM 114.

Figure 14:
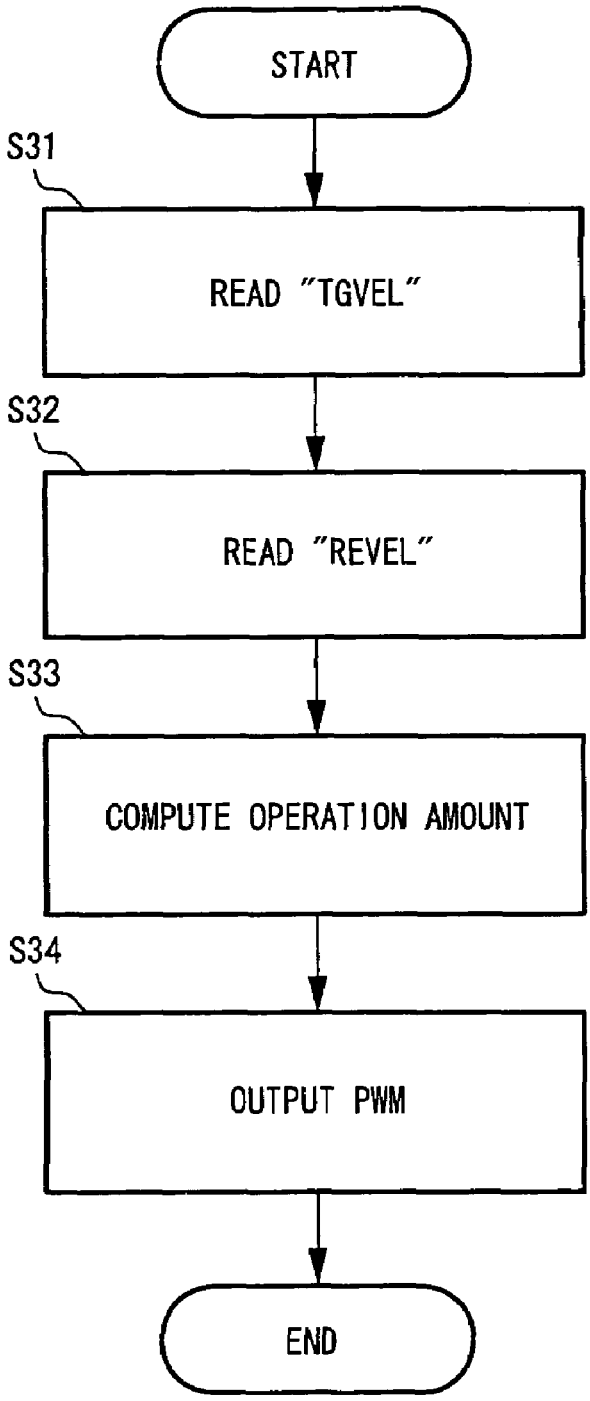
FIG. 14 is a flowchart showing a control of the variable valve event and lift mechanism by the VEL controller.

A flowchart in FIG. 14 shows a control of VEL mechanism 112 by VEL controller 113.

In step S31, the data of the target angle TGVEL transmitted from ECM 114 is read.

In step S32, the angle REVEL of control shaft 16 detected by angle sensor 127 is read.

In step S33, the deviation between the target angle TGVEL and the angle REVEL is computed, and a feedback operating amount of DC servo motor 121 is computed based on the deviation.

In step S34, the pulse width modulated signal PWM for driving DC servo motor 121 is output based on the feedback operating amount computed in step S33.

Figure 15:
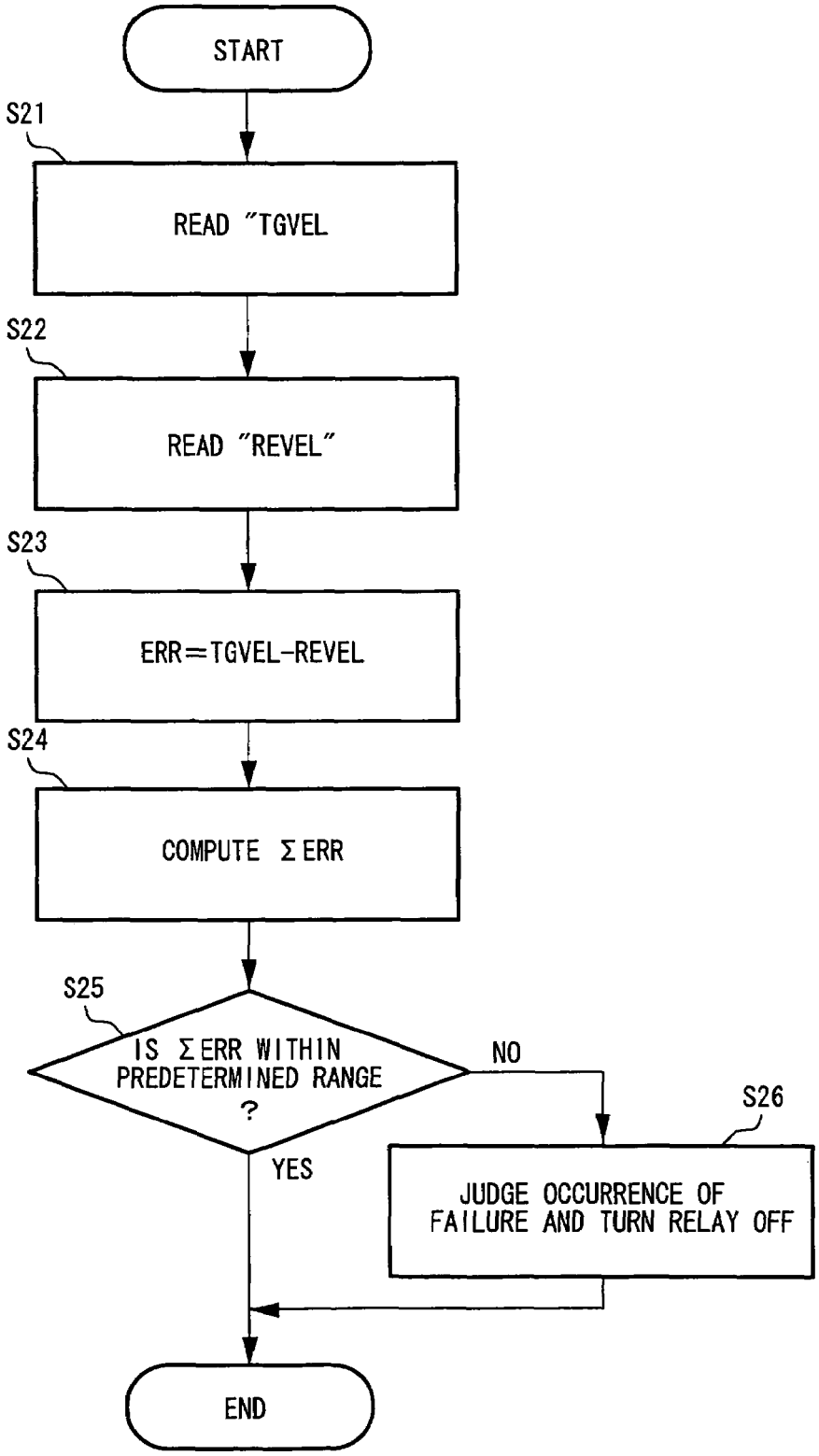
FIG. 15 is a flowchart showing the failure diagnosis and the fail-safe processing of the VEL controller by the ECM.

A flowchart in FIG. 15 shows the failure diagnosis of VEL controller 113 and the fail-safe processing by ECM 114.

In the flowchart of FIG. 15, in step S21, the target angle TGVEL is read.

In step S22, the angle REVEL transmitted from VEL controller 113 is read.

In step S23, the deviation ERR between the target angle TGVEL and the angle REVEL is computed.

$$ERR = TGVEL - REVEL$$

In step S24, an integral value ΣERR of the deviation ERR is computed.

In step S25, it is judged whether or not the integral value ΣERR is within a predetermined range.

Then, when the integral value ΣERR is outside the predetermined range, control proceeds to step S26.

In step S26, it is judged that VEL controller 113 is failed.

Further, in step S26, relay drive circuit 114*c* is controlled to turn relay circuit 306 OFF. As a result, the power supply to motor drive circuit 305 is forcibly shut off, so that the driving of DC servo motor 121 is stopped.

According to the present embodiment, the failure of feedback control function in VEL controller 113 is diagnosed by ECM 114.

Further, when the feedback control function in VEL controller 113 is failed, since the driving of DC servo motor 121 is forcibly stopped by ECM 114, it is possible to avoid that VEL mechanism 112 is erroneously controlled by VEL controller 113.

Moreover, ECM 114 that diagnoses whether or not VEL controller 113 is failed, has functions of controlling a fuel injection quantity of engine 101 and the ignition timing, and also of computing the target angle TGVEL, and accordingly, is not disposed dedicatedly for the failure diagnosis. Therefore, an increase of system cost can be avoided.

Note, it is possible to compute target controlled variable of the variable valve apparatus and also to perform the failure diagnosis, in a control unit that controls an automatic transmission combined with engine 101, in place of ECM 114.

The entire contents of Japanese Patent Application No. 2004-031032 filed on Feb. 6, 2004, a priority of which is claimed, are incorporated herein by reference.

While only selected embodiments have been chosen to illustrate the present invention, it will be apparent to those skilled in the art from this disclosure that various changes and modifications can be made herein without departing from the scope of the invention as defined in the appended claims.

Furthermore, the foregoing description of the embodiments according to the present invention is provided for illustration only, and not for the purpose of limiting the invention as defined in the appended claims and their equivalents.

I claim:

1. A control apparatus for a variable valve apparatus which continuously varies a lift amount and an operating angle of an engine valve of an internal combustion engine due to varying an angle of a control shaft by means of a motor, the control apparatus comprising:

an angle sensor configured to detect the angle of the control shaft;

a first control unit including a drive circuit for driving the motor, and a CPU capable of receiving a signal from the angle sensor and another signal indicating a target angle of the control shaft and of outputting a control signal to the drive circuit;

a power supply controlling circuit capable of controlling the supply of power from a power supply to the drive circuit; and a second control unit capable of computing the target angle of the control shaft to output the target angle after being computed to the CPU, and of receiving the signal detected by and outputted from the angle sensor to thereby diagnose, from the target angle and the signal from the angle sensor, whether or not the first control unit is failed, the second control unit controlling the power supply controlling circuit to shut off of the power supply to the drive circuit when it is determined, by diagnosing, that the first control unit is failed.

2. A control apparatus for a variable valve apparatus according to claim 1, wherein said second control unit comprises a control unit that controls a fuel injection quantity of said internal combustion engine.

3. A control apparatus for a variable valve apparatus according to claim 1, further comprising an automatic transmission arranged to be combined with the internal combustion engine, wherein the second control unit comprises a control unit that controls the automatic transmission.

4. A control apparatus for a variable valve apparatus according to claim 1, wherein said second control unit integrates a deviation between the target angle and the angle of the control shaft detected on the basis of the signal from the angle sensor, and diagnoses that the first control unit is failed, when the integrated value of the deviation is outside a predetermined range.

5. A control apparatus for a variable valve apparatus according to claim 1, wherein the first control unit is configured to transmit the signal from the angle sensor to the second control unit.

6. A control apparatus for a variable valve apparatus according to claim 1, wherein the engine valve comprises an intake valve.

7. A control apparatus for a variable valve apparatus according to claim 1, wherein the first control unit is configured to perform a pulse width modulated controlling (PWM controlling) of the drive circuit for the motor.

8. A control apparatus for a variable valve apparatus which continuously varies a lift amount and an operating angle of an engine valve of an internal combustion engine due to varying an angle of a control shaft by means of a motor, the control apparatus comprising:

an angle detecting unit configured to detect the angle of the control shaft;

first control means including: a drive circuit for driving the motor; and a computing means for receiving a signal from the angle detecting unit together with another signal indicating a target angle of the control shaft and for outputting a control signal to the drive circuit;

a power supply controlling means for controlling the supply of power from a power supply to the drive circuit; and second control means for computing the target angle of the control shaft to output the target angle after being computed to the computing means, and for receiving the signal detected by and outputted from the angle detecting unit, to thereby diagnose, from the target angle and the signal from the angle detecting unit, whether or not the first control means is failed, the second control means controlling the power supply controlling means to shut off the power supply to the drive circuit when it is determined, by diagnosing, that the first control means is failed.

9. A control apparatus for a variable valve apparatus which continuously varies a lift amount and an operating angle of an engine valve of an internal combustion engine due to varying an angle of a control shaft by means of a motor, the control apparatus comprising:

an angle sensor configured to detect the angle of the control shaft;

a variable valve controller including: a drive circuit for driving the motor; and a CPU capable of receiving a signal from the angle sensor together with another signal indicating a target angle of the control shaft, and of outputting a control signal to the drive circuit;

a power supply controlling circuit capable of controlling the supply of power from a power supply to the drive circuit; and an engine control module capable of computing the target angle of the control shaft to output the target angle after being computed to the CPU, and of receiving the signal detected by and outputted from the angle sensor, to thereby diagnose, from the target angle and the signal from the angle sensor, whether or not the variable valve controller is failed, the engine control module controlling the power supply controlling circuit to shut off the power supply to the drive circuit when it is determined, by diagnosing, that the variable valve controller is failed.

* * * * *